US012091631B2

(12) United States Patent
Bedel et al.

(10) Patent No.: US 12,091,631 B2
(45) Date of Patent: Sep. 17, 2024

(54) HYDROCARBON FLUID HAVING IMPROVED COLD TEMPERATURE PROPERTIES

(71) Applicant: TOTALENERGIES ONETECH, Courbevoie (FR)

(72) Inventors: Didier Bedel, Houston, TX (US); Clarisse Doucet, Levallois-Perret (FR); Frédéric Tort, Brignais (FR)

(73) Assignee: TOTALENERGIES ONETECH, Courbevoie (FR)

( * ) Notice: Subject to any disclaimer, the term of this patent is extended or adjusted under 35 U.S.C. 154(b) by 0 days.

(21) Appl. No.: 17/927,830

(22) PCT Filed: Jun. 9, 2021

(86) PCT No.: PCT/EP2021/065504

§ 371 (c)(1),
(2) Date: Nov. 25, 2022

(87) PCT Pub. No.: WO2021/250115

PCT Pub. Date: Dec. 16, 2021

(65) Prior Publication Data

US 2023/0212477 A1 Jul. 6, 2023

(30) Foreign Application Priority Data

Jun. 10, 2020 (EP) ..... 20305631

(51) Int. Cl.

| | |
|---|---|
| ***C10M 169/04*** | (2006.01) |
| ***C10M 145/08*** | (2006.01) |
| ***C10M 145/14*** | (2006.01) |
| *C10N 20/02* | (2006.01) |
| *C10N 20/04* | (2006.01) |
| *C10N 30/02* | (2006.01) |

(52) U.S. Cl.

CPC ..... *C10M 169/041* (2013.01); *C10M 145/08* (2013.01); *C10M 145/14* (2013.01); *C10M 2203/1025* (2013.01); *C10M 2203/1065* (2013.01); *C10M 2209/062* (2013.01); *C10M 2209/084* (2013.01); *C10N 2020/02* (2013.01); *C10N 2020/04* (2013.01); *C10N 2030/02* (2013.01)

(58) Field of Classification Search

CPC ..... C10M 169/041; C10M 145/08; C10M 145/14; C10M 2203/1025; C10M 2203/1065; C10M 2209/062; C10M 2209/084; C10N 2020/02; C10N 2020/04; C10N 2030/02

See application file for complete search history.

(56) References Cited

U.S. PATENT DOCUMENTS

| | | | | |
|---|---|---|---|---|
| 3,627,838 | A | 12/1971 | Ilnyckyj et al. | |
| 3,642,459 | A * | 2/1972 | Ilnyckyj | C08F 10/00 44/393 |
| 6,509,424 | B1 | 1/2003 | Krull et al. | |
| 2006/0100466 | A1 * | 5/2006 | Holmes | C10M 105/04 585/1 |
| 2006/0100467 | A1 * | 5/2006 | Holmes | H01B 3/22 508/110 |
| 2007/0094920 | A1 * | 5/2007 | Ahlers | C10L 1/1973 44/393 |
| 2010/0281762 | A1 | 11/2010 | Chevrot et al. | |
| 2020/0199474 | A1 * | 6/2020 | Hill, Jr. | C09J 11/06 |

FOREIGN PATENT DOCUMENTS

EP 0 007 590 A1 2/1980

OTHER PUBLICATIONS

International Search Report, issued in PCT/EP2021/065504, dated Nov. 17, 2021.
Written Opinion of the International Searching Authority, issued in PCT/EP2021/065504, dated Nov. 17, 2021.

* cited by examiner

*Primary Examiner* — Ellen M McAvoy
(74) *Attorney, Agent, or Firm* — Birch, Stewart, Kolasch & Birch, LLP

(57) ABSTRACT

A composition includes (a) a hydrocarbon fluid comprising less than 1000 ppm by weight of aromatics, a weight ratio normal paraffins/isoparaffins ranging from 0.2 to 1.0 and having an initial boiling point and a final boiling point in the range from 265° C. to 380° C., and (b) a copolymer derived from alpha-olefin monomers and vinyl acetate type monomers and optionally acrylate type monomers.

18 Claims, No Drawings

HYDROCARBON FLUID HAVING IMPROVED COLD TEMPERATURE PROPERTIES

TECHNICAL FIELD

The present invention relates to a low aromatic hydrocarbon fluid having improved cold temperature properties, and in particular an improved pour point.

BACKGROUND OF THE INVENTION

Hydrocarbon fluids find widespread use as solvents such as in adhesives, cleaning fluids, solvents for explosives, for decorative coatings and printing inks, light oils for use in applications such as metal extraction, metalworking or demoulding and industrial lubricants, and drilling fluids. The hydrocarbon fluids can also be used as extender oils in adhesives and sealant systems such as silicone sealants and as viscosity depressants in plasticised polyvinyl chloride formulations and as carrier in polymer formulation used as flocculants for example in water treatment, mining operations or paper manufacturing and also used as thickener for printing pastes, as plasticizers in tyre materials. Hydrocarbon fluids may also be used as solvents in a wide variety of other applications such as phytosanitary compositions, anti-dust applications, heat-transfer applications, automotive applications or electrical insulation applications.

The chemical nature and composition of hydrocarbon fluids varies considerably according to the use to which the fluid is to be put. Important properties of hydrocarbon fluids are the distillation range generally determined by ASTM D-86 or the ASTM D-1160 vacuum distillation technique used for heavier materials, flash point, density, aniline point as determined by ASTM D-611, aromatic content, sulphur content, viscosity, colour and refractive index.

These fluids tend to have narrow boiling point ranges as indicated by a narrow range between Initial Boiling Point (IBP) and Final Boiling Point (FBP) according to ASTM D-86. The Initial Boiling Point and the Final Boiling Point will be chosen according to the use to which the fluid is to be put. However, the use of the narrow cuts provides the benefit of a high flash point and may also prevent the emission of Volatile Organic Compounds which are important for safety reasons. The narrow cut also brings important fluid properties such as a better-defined aniline point or solvency power, then viscosity, and defined evaporation conditions for systems where drying is important, and finally a better-defined surface tension.

Some applications of hydrocarbon fluids require very low aromatic contents and good extreme cold temperature properties.

There is a need to provide a hydrocarbon fluid-containing composition having a very low content of aromatics and a low pour point, while still having satisfying properties for their intended use.

SUMMARY OF THE INVENTION

The present invention relates to a composition comprising:

(a) a hydrocarbon fluid comprising less than 1000 ppm by weight of aromatics, having a weight ratio normal paraffins/isoparaffins ranging from 0.2 to 1.0 and having an initial boiling point and a final boiling point in the range from 265° C. to 380° C., (b) a copolymer consisting of n repetition units of formula (I), m repetition units of formula (II) and p repetition units of formula (III):

(I)

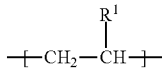

(II)

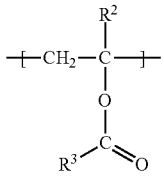

(III)

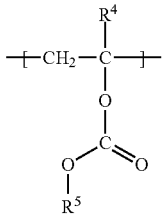

Wherein:

$R^1$ is selected from hydrogen and an alkyl group having from 1 to 4 carbon atoms, $R^2$ is selected from hydrogen and a methyl group, $R^3$ is selected from an alkyl group having from 1 to 24 carbon atoms, $R^4$ is selected from hydrogen and a methyl group, $R^5$ is selected from an alkyl group having from 1 to 24 carbon atoms, n and m are independently to each other integers ranging from 2 to 500, p ranges from 0 to 200.

According to an embodiment, the hydrocarbon fluid comprises less than 500 ppm by weight of aromatics, preferably less than 300 ppm by weight of aromatics, based on the total weight of the hydrocarbon fluid.

According to an embodiment, the hydrocarbon fluid has a kinematic viscosity at 40° C. ranging from 1 to 20 $mm^2/s$, preferably from 2 to 15 $mm^2/s$, more preferably from 3 to 10 $mm^2/s$.

According to an embodiment, the hydrocarbon fluid comprises a naphthen content ranging from 5 to 40% wt, preferably from 7 to 30% wt, more preferably from 8 to 25% wt, based on the total weight of the hydrocarbon fluid.

According to an embodiment the hydrocarbon fluid has a weight ratio normal paraffins/isoparaffins ranging from 0.3 to 0.9, preferably from 0.35 to 0.8.

According to an embodiment of the invention, in the copolymer (b), the repetition unit of formula (I) is obtained from the monomer ethylene and the repetition unit of formula (II) is obtained from the monomer vinyl acetate and p is zero.

According to an embodiment, the copolymer is added into the composition via a copolymer solution comprising the copolymer (b) and a solvent, the solvent comprising less than 300 ppm by weight of aromatics, based on the total weight of the solvent, and the copolymer solution comprising from 10 to 80% wt of dry weight of copolymer (b), preferably from 20 to 70% of dry weight of copolymer (b), based on the total weight of the copolymer solution.

According to an embodiment, the composition comprises from 10 ppm to 10% of dry weight of the copolymer (b), preferably from 50 ppm to 5% of dry weight of the copolymer (b), more preferably from 100 ppm to 1% wt of dry weight of the copolymer (b), based on the total weight of the composition.

According to an embodiment, the composition further comprises at least one anti-settling additive, preferably in an amount ranging from 10 ppm to 5% by weight, preferably from 50 ppm to 1% by weight, based on the total weight of the composition.

The present invention is also directed to the use of a copolymer consisting of n repetition units of formula (I), m repetition units of formula (II) and p repetition units of formula (III):

(I)

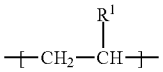

(II)

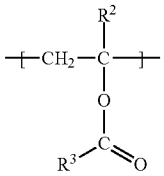

(III)

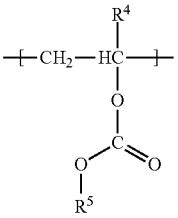

Wherein:

$R^1$ is selected from hydrogen and an alkyl group having from 1 to 4 carbon atoms, $R^2$ is selected from hydrogen and a methyl group, $R^3$ is selected from an alkyl group having from 1 to 24 carbon atoms, $R^4$ is selected from hydrogen and a methyl group, $R^5$ is selected from an alkyl group having from 1 to 24 carbon atoms, n and m are independently to each other integers ranging from 2 to 500, p ranges from 0 to 200, in order to improve the low temperature properties of a hydrocarbon fluid comprising less than 1000 ppm by weight of aromatics, a weight ratio normal paraffins/isoparaffins ranging from 0.2 to 1.0 and having an initial boiling point and a final boiling point in the range from 265° C. to 380° C.

The use of the invention preferably lowers the pour point of the hydrocarbon fluid. Preferably, the pour point of the hydrocarbon fluid is lowered by at least 10° C., preferably at least 20° C., more preferably at least 25° C.

According to an embodiment of the use of the invention, the hydrocarbon fluid has one or more of the following features:

the hydrocarbon fluid comprises less than 500 ppm by weight of aromatics, preferably less than 300 ppm by weight of aromatics, based on the total weight of the hydrocarbon fluid, and/or the hydrocarbon fluid has a kinematic viscosity at 40° C. ranging from 1 to 20 $mm^2/s$, preferably from 2 to 15 $mm^2/s$, more preferably from 3 to 10 $mm^2/s$, and/or the hydrocarbon fluid comprises a naphthene content ranging from 5 to 30% wt, preferably from 7 to 20% wt, based on the total weight of the hydrocarbon fluid, and/or the hydrocarbon fluid has a weight ratio normal paraffins/isoparaffins ranging from 0.3 to 0.9, preferably from 0.35 to 0.8.

According to an embodiment of the use of the invention, the copolymer has one or more of the following features:

the repetition unit of formula (I) is ethylene and the repetition unit of formula (II) is vinyl acetate and p is zero, and/or the copolymer is added into the composition via a copolymer solution comprising the copolymer (b) and a solvent, the solvent comprising less than 300 ppm by weight of aromatics, based on the total weight of the solvent, and the copolymer solution comprising from 10 to 80% wt of dry weight of copolymer (b), preferably from 20 to 70% of dry weight of copolymer (b), based on the total weight of the copolymer solution.

According to an embodiment of the use of the invention, the copolymer (b) is added into the hydrocarbon fluid in an amount ranging from 10 ppm to 10% of dry weight of the copolymer (b), preferably from 50 ppm to 5% of dry weight of the copolymer (b), more preferably from 100 ppm to 1% wt of dry weight of the copolymer (b), based on the total weight of the composition comprising the hydrocarbon fluid and the copolymer (b) and an optional solvent.

The composition of the invention is particularly useful as solvent in phytosanitary compositions, in anti-dust applications, in heat-transfer applications, in automotive applications or in electrical insulation applications.

In particular, the composition of the invention will reply to the pharmacopeia.

DETAILED DESCRIPTION OF THE INVENTION

The present invention concerns a composition comprising:

(a) a hydrocarbon fluid comprising less than 1000 ppm by weight of aromatics, having a weight ratio normal paraffins/isoparaffins ranging from 0.2 to 1.0 and having an initial boiling point and a final boiling point in the range from 265° C. to 380° C., (b) a copolymer consisting of n repetition units of formula (I), m repetition units of formula (II) and p repetition units of formula (III):

(I)

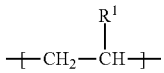

(II)

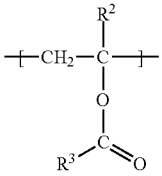

-continued (III)

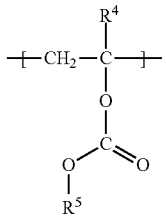

Wherein:

$R^1$ is selected from hydrogen and an alkyl group having from 1 to 4 carbon atoms, $R^2$ is selected from hydrogen and a methyl group, $R^3$ is selected from an alkyl group having from 1 to 24 carbon atoms, $R^4$ is selected from hydrogen and a methyl group, $R^5$ is selected from an alkyl group having from 1 to 24 carbon atoms, n and m are independently to each other integers ranging from 2 to 500, p ranges from 0 to 200.

Hydrocarbon Fluid a)

The hydrocarbon fluid comprises less than 1000 ppm by weight of aromatics, preferably less than 500 ppm by weight, more preferably less than 300 ppm by weight, based on the total weight of the hydrocarbon fluid. The aromatic content can be measured according to well known methods for the skilled person, for example by UV spectrometry.

The hydrocarbon fluid has a weight ratio normal paraffins/isoparaffins ranging from 0.2 to 1.0, preferably from 0.3 to 0.9, more preferably from 0.35 to 0.80. The amount of normal paraffin and isoparaffins can be measured according to well known methods for the skilled person, for example by gas chromatography.

According to an embodiment, the hydrocarbon fluid has a normal paraffin content ranging from 5 to 50% wt, preferably from 10 to 45% wt, more preferably from 15 to 40% wt, based on the total weight of the hydrocarbon fluid.

According to an embodiment, the hydrocarbon fluid has an isoparaffin content ranging from 30 to 80% wt, preferably from 35 to 75% wt, more preferably from 40 to 70% wt, based on the total weight of the hydrocarbon fluid.

According to an embodiment, the hydrocarbon fluid comprises a naphthene content ranging from 5 to 40% wt, preferably from 7 to 30% wt, more preferably from 8 to 25% wt, based on the total weight of the hydrocarbon fluid. The content of naphthenic compounds can be measured by gas chromatography.

Within the meaning of the present invention, by "aromatics", it is to be understood compounds having at least one aromatic ring. If the aromatic compound is a monoaromatic, said compound comprises only one ring and if the aromatic compound is a polyaromatic, said compound comprises at least two aromatic rings.

Within the meaning of the present invention, by "normal paraffins", it is to be understood saturated linear compounds.

Within the meaning of the present invention, by "isoparaffins", it is to be understood saturated branched compounds. Within the meaning of the present invention, by "naphthens", it is to be understood saturated cyclic compounds, having one or more rings, the ring(s) being optionally substituted by alkyl group(s). If the naphthenic compound is a mononaphthenic, said compound comprises only one saturated ring and if the naphthenic compound is a polynaphthenic, said compound comprises at least two saturated rings.

According to an embodiment, the hydrocarbon fluid comprises:

from 5 to 50% wt, preferably from 10 to 45% wt, more preferably from 15 to 40% wt, of normal paraffins, from 30 to 80% wt, preferably from 35 to 75% wt, more preferably from 40 to 70% wt, of isoparaffins, from 5 to 30% wt, preferably from 7 to 20% wt, more preferably from 8 to 25% wt, of naphthens, based on the total weight of the hydrocarbon fluid, being understood that the weight ratio normal paraffins/isoparaffins ranges from 0.2 to 1.0, preferably from 0.3 to 0.9, more preferably from 0.35 to 0.80.

The hydrocarbon fluid has an initial boiling point and a final boiling point in the range from 265° C. to 380° C., preferably from 275° C. to 380° C., more preferably from 290° C. to 375° C., even more preferably from 300 to 375° C. The initial boiling point and the final boiling point can be measured according to the ASTM D-86 standard.

According to an embodiment, the hydrocarbon fluid has a boiling range below 80° C., preferably below 70° C., more preferably below 60° C., even more preferably between 30 and 60° C.

Within the meaning of the present invention, the "boiling range" is the difference between the final boiling point and the initial boiling point.

According to an embodiment, the hydrocarbon fluid has a kinematic viscosity at 40° C. ranging from 1 to 20 $mm^2/s$, preferably from 2 to 15 $mm^2/s$, more preferably from 3 to 10 $mm^2/s$. The kinematic viscosity can be measured according to standard ASTM D 445.

According to an embodiment, the hydrocarbon fluid has a pour point above −6° C., preferably from 0 to +15° C. The pour point of the hydrocarbon fluid can be measured according to standard ASTM D 97.

The hydrocarbon fluid can be obtained in the following way. The hydrocarbon fluid according to the invention is a hydrocarbon fluid which can be derived in a known manner from fossil sources such as crude petroleum or from renewable sources, such as biomass or products issued from recycling process.

Preferably, for the purposes of the invention, the term "hydrocarbon fluid" is intended to mean a fraction resulting from the distillation of crude petroleum, preferably resulting from the atmospheric distillation and/or the vacuum distillation of crude petroleum, preferably resulting from atmospheric distillation followed by vacuum distillation.

The hydrocarbon fluid used in the composition of the invention is advantageously obtained by means of a process comprising hydrotreatment, hydrocracking and/or catalytic cracking steps.

The hydrocarbon fluid used in the composition of the invention is preferably obtained by means of a process comprising dearomatization and optionally desulfurization steps.

According to an embodiment, the hydrocarbon fluid according to the invention is not subjected to a dewaxing step. Dewaxing is a known process for treating hydrocarbon fractions without conversion, consisting in removing the paraffins and the microcrystalline waxes from a feedstock or in converting them into compounds of lower molecule weight and/or of different molecular structure. The dewaxing processes conventionally known are solvent-extraction or hydrodewaxing processes. During these processes, the normal paraffins are extracted or converted into isoparaffins in order generally to obtain a lower pour point. The term "dewaxing" is intended to mean a treatment process which makes it possible to obtain a hydrocarbon fluid comprising a weight content of normal paraffins of less than 10%. Processes resulting in partial dewaxing of the hydrocarbon fraction are not excluded from the invention.

According to an embodiment, the hydrocarbon fluid obtained after the distillation step(s) is chosen from gas oil fractions or mineral oil fractions. The gas oil fraction is preferably obtained by means of a process comprising hydrotreatment, hydrocracking and/or catalytic cracking steps, optionally followed by dearomatization and optionally desulfurization steps. The mineral fraction is preferably obtained by means of a process comprising vacuum-distillation, solvent-extraction and optionally partial dewaxing and hydrotreatment or hydrocracking steps.

The hydrocarbon fluid may be a mixture of hydrocarbon fluids which have undergone the steps described above.

The hydrocarbon fluid used in the composition of the invention may also result from the conversion of biomass.

The expression "result from the conversion of biomass" is intended to mean a hydrocarbon fluid produced from raw materials of biological origin, preferably chosen from vegetable oils, animal fats, fish oils and mixtures thereof. Appropriate raw materials of biological origin are for example rapeseed oil, canola oil, tall oil, sunflower oil, soybean oil, hemp oil, olive oil, linseed oil, mustard oil, carinata oil, palm oil, peanut oil, castor oil, coconut oil, animal fats such as tallow or recycled food fats, raw materials resulting from genetic engineering, and biological raw materials produced from microorganisms such as algae and bacteria.

Preferably, the hydrocarbon fluid of biological origin is obtained by means of a process comprising hydrodeoxygenation (HDO) and isomerization steps. The hydrodeoxygenation (HDO) step results in the decomposition of the structures of the biological esters or of the triglyceride constituents, in the elimination of the oxygen-bearing, phosphorus-bearing and sulfur-bearing compounds and in the hydrogenation of olefinic bonds. The product resulting from the hydrodeoxygenation reaction is then isomerized. A fractionation step can preferably follow the hydrodeoxygenation and isomerization steps.

The fractions of interest are then subjected to hydrotreatment then distillation steps in order to obtain the specifications of the desired hydrocarbon fluid according to the invention.

The hydrocarbon fluid may be a mixture of hydrocarbon fluids resulting from the distillation of crude petroleum and/or from the conversion of biomass.

Preferably, the hydrocarbon fluid is a hydrocarbon fraction resulting from the distillation of crude petroleum.

Advantageously, the hydrocarbon fluid is a hydrogenated hydrocarbon fluid.

Copolymer b)

The copolymer b) consists of n repetition units of formula (I), m repetition units of formula (II) and p repetition units of formula (III), wherein n and m are independently to each other integers ranging from 2 to 500 and wherein p ranges from 0 to 200.

Formulas (I), (II) and (III) are the following formulas:

(I)

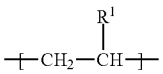

-continued (II)

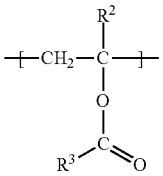

(III)

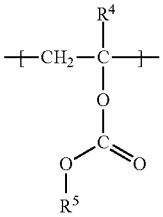

Wherein:

$R^1$ is selected from hydrogen and an alkyl group having from 1 to 4 carbon atoms, $R^2$ is selected from hydrogen and a methyl group, $R^3$ is selected from an alkyl group having from 1 to 24 carbon atoms, $R^4$ is selected from hydrogen and a methyl group, $R^5$ is selected from an alkyl group having from 1 to 24 carbon atoms.

The copolymer b) can comprise one or more different units of formula (I), and/or one or more different units of formula (II), and/or one or more different units of formula (III) if present. According to a preferred embodiment, all the units of formula (I) are identical and/or all the units of formula (II) are identical, and/or all the units of formula (III) if present are identical, preferably all the units of formula (I) are identical and all the units of formula (II) are identical, and all the units of formula (III) if present are identical.

According to an embodiment, the copolymer b) is obtained by copolymerisation of two or three different monomers, preferably of one alpha-olefin monomer and of one vinyl ester monomer and optionally further of one beta-unsaturated carboxylic acid ester monomer (or acrylate monomer).

According to an embodiment, the unit of formula (I) is derived from "ethylene" monomers, i.e. is obtained by polymerisation of ethylene.

According to an embodiment, the units of formula (I), preferably derived from ethylene, represent from 50 to 90% wt of the total weight of the copolymer.

According to an embodiment, the units of formula (II) are derived from "vinyl ester" monomers, i.e. Is obtained by polymerisation of a vinyl ester. Among vinyl ester, mention may be made of vinyl acetate, vinyl propionate, vinyl laurate, 2-ethylhexanoic acid vinyl ester, vinyl neodecanoate, vinyl neononanoate, vinyl neoundecanoate, and mixtures thereof. Preferably, the vinyl ester is vinyl acetate.

According to an embodiment, the units of formula (II), preferably derived from one or two vinyl esters, more preferably from vinyl acetate and optionally vinyl neodecanoate, represent from 10 to 50% wt of the total weight of the copolymer.

According to an embodiment, the unit of formula (III) is not present (embodiment wherein p is zero).

According to an embodiment, the copolymer b) consists in:

from 50 to 90% wt of monomers derived from ethylene, from 10 to 50% wt of monomers derived from vinyl esters, preferably from vinyl acetate optionally in combination with vinyl neodecanoate, based on the total weight of the copolymer b).

According to another embodiment, the unit of formula (III) is derived from "(meth)acrylate" monomers, i.e. is obtained by polymerisation of (meth)acrylates. Among (meth)acrylates, mention may be made of 2-ethylhexyl acrylate, methyl acrylate, methyl methacrylate, ethyl acrylate. Preferably, the (meth)acrylate is 2-ethylhexyl acrylate.

When present, the units of formula (III), preferably derived from (meth)acrylate, represent from 1 to 25% wt of the total weight of the copolymer.

According to an embodiment, the copolymer b) consists in:

from 50 to 88% wt of monomers derived from ethylene, from 10 to 30% wt of monomers derived from vinyl esters, preferably from vinyl acetate optionally in combination with vinyl neodecanoate, from 1 to 25% wt of monomers derived from (meth) acrylates, preferably from 2-ethylhexyl acrylate, based on the total weight of the copolymer b).

According to an embodiment, the copolymer b) is a random copolymer.

Preferably, the copolymer b) has a weight average molecular weight (Mw) ranging from 1000 to 50000, preferably from 3000 to 30000 Da.

Preferably, the copolymer b) has a number average molecular weight (Mn) ranging from 800 to 25000, preferably from 1000 to 15000 Da.

The weight average molecular weight and the number average molecular weight can be measured by gel permeation chromatography (GPC).

These copolymers b) can be prepared in a known manner by any polymerization process, (see for example, Ullmann's Encyclopedia of Industrial Chemistry, 5th Edition, "Waxes", Vol. A 28, p. 146; U.S. Pat. No. 3,627,838; EP 7590) in particular by radical polymerization, preferably under high pressure, typically of the order of 1,000 to 3,000 bars (100 to 300 MPa), preferably 1,500 to 2,000 bars (150 to 200 MPa), the reaction temperatures generally ranging from 160 to 320° C., preferably from 200 to 280° C., and in the presence of at least one radical initiator generally chosen from the organic peroxides and/or the oxygenated or nitrogenated compounds, and a molecular weight regulator (ketone or aliphatic aldehyde etc.). The copolymers can for example be prepared in a tubular reactor according to the process described in U.S. Pat. No. 6,509,424.

The composition of the invention can comprise one or several copolymers b) as described above, preferably only one copolymer b) as described above.

Preferably, the copolymer b) is added into the composition of the invention via a copolymer solution comprising the copolymer (b) and a solvent.

According to an embodiment, the solvent comprises less than 300 ppm by weight of aromatics, preferably less than 100 ppm by weight of aromatics, based on the total weight of the solvent.

Preferably, the copolymer solution comprises from 10 to 80% of dry weight of copolymer (b), preferably from 20 to 70% of dry weight of copolymer (b), based on the total weight of the copolymer solution.

The copolymer solution may be obtained by adding the copolymer previously heated to a temperature of from 80 to 120° C. into the solvent at ambient temperature (about 25° C.). Then, the mixture can be stirred until an homogeneous solution is obtained.

Composition of the Invention

The composition of the invention comprises at least one hydrocarbon fluid a) and at least one copolymer b).

Preferably, the composition comprises from 10 ppm to 10% of dry weight of the copolymer b), preferably from 50 ppm to 5% of dry weight of the copolymer b), more preferably from 100 ppm to 1% wt of dry weight of the copolymer b), based on the total weight of the composition.

Preferably, the composition comprises at least 90% wt of hydrocarbon fluid(s), preferably at least 95% wt of hydrocarbon fluid(s), more preferably at least 99% wt of hydrocarbon fluid(s), based on the total weight of the composition.

According to an embodiment, the composition of the invention further comprises at least one anti-settling additive, preferably in an amount ranging from 10 ppm to 5% by weight, preferably from 50 ppm to 1% by weight, based on the total weight of the composition.

The composition of the invention can be prepared by adding the copolymer, preferably via a copolymer solution, into a hydrocarbon fluid, preferably at a temperature ranging from 15 to 45° C., preferably at ambient temperature.

Use of the Invention

The invention is also directed to the use of a copolymer b) as described in the present invention to improve the low temperature properties of a hydrocarbon fluid comprising less than 1000 ppm by weight of aromatics, a weight ratio normal paraffins/isoparaffins ranging from 0.2 to 1.0 and having an initial boiling point and a final boiling point in the range from 265° C. to 380° C.

Preferably, the hydrocarbon fluid within the context of the use of the invention has one or several of the characteristics described above in the context of the composition of the invention.

The copolymer b) of the invention allows reducing the pour point of the hydrocarbon fluid. Indeed, the inventors surprisingly found that the copolymer b) can be suitably used in order to improve the pour point of hydrocarbon fluids having very low amount of aromatics and a relatively high weight ratio of n-paraffins/isoparaffins, and in particular of hydrocarbon fluids combining a very low amount of aromatics, a relatively high weight ratio of n-paraffins/isoparaffins and a relatively high pour point, typically a pour point of at least −6° C.

Preferably, the pour point of the hydrocarbon fluid is lowered by at least 10° C., preferably at least 20° C., more preferably at least 25° C., after addition of the copolymer b) into the hydrocarbon fluid, typically the copolymer b) is added in an amount ranging from 10 ppm to 10% of dry weight, preferably from 50 ppm to 5% of dry weight, more preferably from 100 ppm to 1% wt of dry weight, based on the total weight of the composition (mixture of hydrocarbon fluid, copolymer b) and optional solvent).

The invention also relates to a process for improving the pour point of a hydrocarbon fluid, said process comprising a step of introducing a copolymer b) as described above into a hydrocarbon fluid a) as described above.

The hydrocarbon fluid a) and the copolymer b), in the context of the process of the invention, preferably have one or more of the characteristics described above in relation to the composition of the invention.

According to an embodiment, the process comprises a step wherein the pour point of the hydrocarbon fluid is reduced, preferably by at least 10° C., preferably at least 20° C., more preferably at least 25° C., after addition of the copolymer b) into the hydrocarbon fluid, typically the copolymer b) is added in an amount ranging from 10 ppm to 10% of dry weight, preferably from 50 ppm to 5% of dry weight, more preferably from 100 ppm to 1% wt of dry weight, based on the total weight of the composition (mixture of hydrocarbon fluid, copolymer b) and optional solvent).

EXAMPLES

The invention is now described with the help of the following examples, which are not intended to limit the scope of the present invention, but are incorporated to illustrate advantages of the present invention and best mode to perform it.

Hydrocarbon fluids described in the table 1 below have been used in the present examples.

TABLE 1

| hydrocarbon fluids | | | | |
|---|---|---|---|---|
| | Standards/methods | HC fluid 1 | HC fluid 2 | HC fluid 3 |
| ppm aromatics | UV spectrometry | 100 | 306 | 52 |
| % wt isoparaffins | GC chromatography | 64.04 | 49.86 | 51.44 |
| % wt n-paraffins | GC chromatography | 23.18 | 36.62 | 32.67 |
| % wt naphthens | GC chromatography | 12.77 | 13.52 | 15.89 |
| Initial Boiling Point (° C.) | ASTM D86 | 302.1 | 303.1 | 275.6 |
| Final Boiling Point (° C.) | ASTM D86 | 343.7 | 372.6 | 322.8 |
| Pour point (° C.) | ASTM D97 | −6° C. | 9° C. | −3° C. |
| Kinematic viscosity at 40° C. ($mm^2/s$) | ASTM D445 | 5.841 | 8.085 | 4.938 |
| Density at 15° C. | ASTM D4052 | 814.3 | 836.3 | 827.4 |

Copolymers described in table 2 below have been used in the present examples.

TABLE 2

| Copolymers | | | | |
|---|---|---|---|---|
| | Copo1 | Copo2 | Copo3 | Copo4 |
| Mw (g/mol) | 8500 | 9500 | 9300 | 9000 |
| Mn (g/mol) | 5000 | 6200 | 4000 | 5000 |
| Nature of the monomer leading to the units of formula (I) | ethylene | ethylene | ethylene | ethylene |
| % weight of units of formula (I) | 69.5% | 67% | 62% | 58% |
| Nature of the monomer leading to the units of formula (II) | Vinyl acetate | Vinyl acetate | Vinyl acetate | Vinyl acetate and vinyl versatate |
| % weight of units of formula (II) | 30.5% | 33% | 29% | 0% |
| Nature of the monomer leading to the units of formula (III) | — | — | 2-ethylhexyl acrylate | vinyl versatate |
| % weight of units of formula (III) | 0 | 0 | 10 | 12 |

Solutions of copolymers have been prepared, by mixture of each copolymer in a solvent as described in table 3.

TABLE 3

| copolymer solutions | | | | | | | |
|---|---|---|---|---|---|---|---|
| | Solu1 | Solu2 | Solu3 | Solu4 | Solu5 | Solu6 | Solu7 |
| % of dry weight copo1 | 50 | 50 | 70 | | | | 47.5 |
| % of dry weight copo2 | | | | 70 | | | |
| % of dry weight copo3 | | | | | 75 | | |
| % of dry weight copo4 | | | | | | 70 | 20.3 |
| % of dry WASA | | | | | | | 1.5 |
| % wt of solvent 1 | 50 | | | | | | |
| % wt of solvent 2 | | 50 | | | | | |
| % wt of solvent 3 | | | 30 | 30 | 25 | 30 | 30.7 |
| Kinematic viscosity at 40° C. ($mm^2/s$) | 127.1 | 89.27 | 438.5 | 384.2 | 603.9 | 260 | 300 |

TABLE 3-continued

| copolymer solutions | | | | | | | |
|---|---|---|---|---|---|---|---|
| | Solu1 | Solu2 | Solu3 | Solu4 | Solu5 | Solu6 | Solu7 |
| Kinematic viscosity at 20° C. ($mm^2/s$) | 515.8 | 309.7 | ND | ND | ND | ND | ND |
| Pour point (° C.) | 15 | 6 | 24 | 15 | 12 | 3 | 18 |

TABLE 3-continued

| copolymer solutions | | | | | | | |
|---|---|---|---|---|---|---|---|
| | Solu1 | Solu2 | Solu3 | Solu4 | Solu5 | Solu6 | Solu7 |
| Density at 15° C. (ASTM D4052) | 851.8 | 870.6 | 923.3 | 927.3 | 927 | 897 | 913.5 |

Solvent 1 = hydrocarbon solvent having less than 20 ppm by weight of aromatic (UV spectrometry) and an initial boiling point of 264° C. and a final boiling point of 306.8° C. according to ASTM D86.
Solvent 2 = hydrocarbon solvent having less than 5% vol of aromatic (ASTM D 1319) and an initial boiling point of 197° C. and a final boiling point of about 240° C. according to ASTM D86.
Solvent 3 = hydrocarbon solvent having 99% wt of aromatic (GC spectrometry) and an initial boiling point of 184° C. and a final boiling point of 208.5° C. according to ASTM D850.
WASA = wax anti-settling additive (cloud point additive).
ND = not determined.

The solutions of copolymers detailed in tale 3 have been added into hydrocarbon fluids detailed in table 1. The pour point of the resulting compositions has been determined and indicated in tables below In tables 4 and 4a, the hydrocarbon fluid "HC fluid 1" (as detailed in table 1) has been used. The amount of each copolymer solution (Solu1, Solu2, Solu3, Solu4, Solu6 and Solu7) has been indicated in ppm by weight. The pour point (PP) is indicated in ° C.

TABLE 4

| compositions with HC fluid 1 | | | | | | | | | |
|---|---|---|---|---|---|---|---|---|---|
| | C1 | C2 | C3 | C4 | C5 | C6 | C7 | C8 | C9 |
| Solu1 | 500 | 1000 | 1500 | | | | | | |
| Solu2 | | | | 400 | 1000 | 1500 | | | |
| Solu3 | | | | | | | 500 | 1000 | 1500 |
| Solu4 | | | | | | | | | |
| Solu6 | | | | | | | | | |
| PP | −15 | −42 | −48 | −33 | −45 | −48 | −33 | −42 | −51 |

TABLE 4a

| compositions with HC fluid 1 | | | | | | | | |
|---|---|---|---|---|---|---|---|---|
| | C10 | C11 | C12 | C13 | C14 | C15 | C16 | C17 |
| Solu1 | | | | | | | | |
| Solu2 | | | | | | | | |
| Solu3 | | | | | | | | |
| Solu4 | 200 | 400 | 600 | | | | | |
| Solu6 | | | | 200 | 400 | 600 | | |
| Solu7 | | | | | | | 375 | 500 |
| PP | −15 | −30 | −39 | −24 | −39 | −42 | −24 | −45 |

In table 5, the hydrocarbon fluid "HC fluid 2" (as detailed in table 1) has been used. The amount of each copolymer solution (Solu1, Solu2, Solu3, Solu4 and Solu5) has been indicated in ppm by weight. The pour point (PP) is indicated in ° C.

The compositions C31 and C32 further comprise a wax anti-settling additive (WASA). The amount of this additive is indicated in ppm by weight in table 4.

TABLE 5

| compositions with HC fluid 2 | | | | | | | | | | | | | | |
|---|---|---|---|---|---|---|---|---|---|---|---|---|---|---|
| | C18 | C19 | C20 | C21 | C22 | C23 | C24 | C25 | C27 | C28 | C29 | C30 | C31 | C32 |
| Solu1 | 500 | 1000 | 1500 | | | | | | | | | | | |
| Solu2 | | | | 500 | 1000 | 1500 | | | | | | | | |
| Solu3 | | | | | | | 500 | 1000 | | | | | | |
| Solu4 | | | | | | | | | 500 | 1000 | | | | |
| Solu5 | | | | | | | | | | | 500 | 1000 | 500 | 1000 |
| WASA | | | | | | | | | | | | | 200 | 200 |
| PP | −18 | −27 | −24 | −21 | −21 | −27 | −27 | −30 | −24 | −27 | −33 | −33 | −33 | −42 |

In table 6, the hydrocarbon fluid "HC fluid 3" (as detailed in table 1) has been used. The amount of each copolymer solution (Solu1, Solu2, Solu3, Solu4 and Solu5) has been indicated in ppm by weight. The pour point (PP) is indicated in ° C.

TABLE 6

| compositions with HC fluid 3 | | | | | | | | | | | |
|---|---|---|---|---|---|---|---|---|---|---|---|
| | C33 | C34 | C35 | C36 | C37 | C38 | C39 | C40 | C41 | C42 | C43 |
| Solu1 | 1000 | 1500 | 2000 | | | | | | | | |
| Solu2 | | | | 1000 | 2500 | | | | | | |
| Solu3 | | | | | | 500 | 1000 | | | | |
| Solu4 | | | | | | | | 500 | 1500 | | |
| Solu5 | | | | | | | | | | 500 | 1000 |
| PP | −12 | −15 | −30 | −9 | −18 | −6 | −18 | −12 | −15 | −15 | 18 |

The results of tales 4, 4a, 5 and 6 show that the compositions of the invention have improved cold temperature properties. The compositions contain very low content of aromatic and substantial amount of normal paraffins, which make them suitable for specific uses requiring these features, and additionally the compositions of the invention show improved low temperature properties.

The invention claimed is:

1. A composition comprising:

(a) a hydrocarbon fluid comprising less than 1000 ppm by weight of aromatics, having a weight ratio normal paraffins/isoparaffins ranging from 0.2 to 1.0 and having an initial boiling point and a final boiling point in the range from 265° C. to 380° C., the hydrocarbon fluid comprising a naphthene content ranging from 5 to 40% wt, based on the total weight of the hydrocarbon fluid, (b) a copolymer consisting of n repetition units of formula (I), m repetition units of formula (II) and p repetition units of formula (III):

(I)

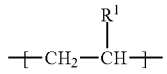

(II)

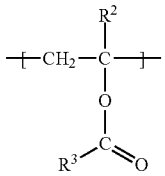

(III)

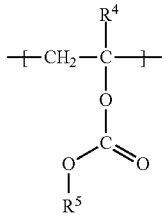

Wherein:

$R^1$ is selected from hydrogen and an alkyl group having from 1 to 4 carbon atoms, $R^2$ is selected from hydrogen and a methyl group, $R^3$ is selected from an alkyl group having from 1 to 24 carbon atoms, $R^4$ is selected from hydrogen and a methyl group, $R^5$ is selected from an alkyl group having from 1 to 24 carbon atoms, n and m are independently to each other integers ranging from 2 to 500, p ranges from 0 to 200.

2. The composition according to claim 1, wherein the hydrocarbon fluid comprises less than 500 ppm by weight of aromatics, based on the total weight of the hydrocarbon fluid.

3. The composition according to claim 1, wherein the hydrocarbon fluid has a kinematic viscosity at 40° ° C. ranging from 1 to 20 $mm^2/s$.

4. The composition according to claim 1, wherein the hydrocarbon fluid has a weight ratio normal paraffins/isoparaffins ranging from 0.3 to 0.9.

5. The composition according to claim 1, wherein in the copolymer (b), the repetition unit of formula (I) is obtained from the monomer ethylene and the repetition unit of formula (II) is obtained from the monomer vinyl acetate and p is zero.

6. The composition according to claim 1, wherein the copolymer is added into the composition via a copolymer solution comprising the copolymer (b) and a solvent, the solvent comprising less than 300 ppm by weight of aromatics, based on the total weight of the solvent, and the copolymer solution comprising from 10 to 80% wt of dry weight of copolymer (b), based on the total weight of the copolymer solution.

7. The composition according to claim 1, comprising from 10 ppm to 10% of dry weight of the copolymer (b), based on the total weight of the composition.

8. The composition according to claim 1, further comprising at least one anti-settling additive.

9. The composition according to claim 1, wherein the hydrocarbon fluid comprises one or several of the following features:

the hydrocarbon fluid comprises less than 300 ppm by weight of aromatics, and/or the hydrocarbon fluid has a kinematic viscosity at 40° ° C. ranging from 2 to 15 $mm^2/s$, and/or the hydrocarbon fluid comprises a naphthene content ranging from 7 to 30% wt, and/or the hydrocarbon fluid has a weight ratio normal paraffins/isoparaffins ranging from 0.35 to 0.8.

10. The composition according to claim 6, wherein the copolymer solution comprising from 20 to 70% wt of dry weight of copolymer (b), based on the total weight of the copolymer solution.

11. The composition according to claim 1, comprising from 50 ppm to 5% of dry weight of the copolymer (b), based on the total weight of the composition.

12. The composition according to claim 1, further comprising at least one anti-settling additive, in an amount ranging from 10 ppm to 5% by weight, based on the total weight of the composition.

13. A method to improve the low temperature properties of a hydrocarbon fluid, the method comprising adding a copolymer into the hydrocarbon fluid, the copolymer consisting of n repetition units of formula (I), m repetition units of formula (II) and p repetition units of formula (III):

(I)

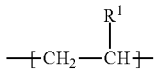

(II)

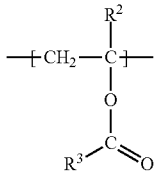

(III)

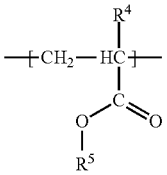

Wherein:

$R^1$ is selected from hydrogen and an alkyl group having from 1 to 4 carbon atoms, $R^2$ is selected from hydrogen and a methyl group, $R^3$ is selected from an alkyl group having from 1 to 24 carbon atoms, $R^4$ is selected from hydrogen and a methyl group, $R^5$ is selected from an alkyl group having from 1 to 24 carbon atoms, n and m are independently to each other integers ranging from 2 to 500, p ranges from 0 to 200, the hydrocarbon fluid comprising less than 1000 ppm by weight of aromatics, a weight ratio normal paraffins/isoparaffins ranging from 0.2 to 1.0 and having an initial boiling point and a final boiling point in the range from 265° ° C. to 380° C.

14. The method according to claim 13, in order to lower the pour point of the hydrocarbon fluid.

15. The method according to claim 14, wherein the pour point of the hydrocarbon fluid is lowered by at least 10° C.

16. The method according to claim 13, wherein the hydrocarbon fluid has one or more of the following features:

the hydrocarbon fluid comprises less than 500 ppm by weight of aromatics, based on the total weight of the hydrocarbon fluid, and/or the hydrocarbon fluid has a kinematic viscosity at 40° ° C. ranging from 1 to 20 $mm^2/s$, and/or the hydrocarbon fluid comprises a naphthene content ranging from 5 to 30% wt, based on the total weight of the hydrocarbon fluid, and/or the hydrocarbon fluid has a weight ratio normal paraffins/isoparaffins ranging from 0.3 to 0.9.

17. The method according to claim 13, wherein the copolymer (b) has one or more of the following features:

the repetition unit of formula (I) is ethylene and the repetition unit of formula (II) is vinyl acetate and p is zero, and/or the copolymer is added into the composition via a copolymer solution comprising the copolymer (b) and a solvent, the solvent comprising less than 300 ppm by weight of aromatics, based on the total weight of the solvent, and the copolymer solution comprising from 10 to 80% wt of dry weight of copolymer (b), based on the total weight of the copolymer solution.

18. The method according to claim 13, wherein the copolymer (b) is added into the hydrocarbon fluid in an amount ranging from 10 ppm to 10% of dry weight of the copolymer (b), based on the total weight of the composition comprising the hydrocarbon fluid and the copolymer (b) and an optional solvent.

* * * * *